US006484515B2

(12) United States Patent
Kim et al.

(10) Patent No.: US 6,484,515 B2
(45) Date of Patent: Nov. 26, 2002

(54) PULSE TUBE REFRIGERATOR

(75) Inventors: Seon Young Kim, Siheung (KR); Dong Kon Hwang, Goyang (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/992,863

(22) Filed: Nov. 27, 2001

(65) Prior Publication Data

US 2002/0112484 A1 Aug. 22, 2002

(30) Foreign Application Priority Data

Feb. 17, 2001 (KR) ..... 2001-8018

(51) Int. Cl.[7] ..... F25B 9/00
(52) U.S. Cl. ..... 62/6
(58) Field of Search ..... 62/6; 60/520

(56) References Cited

U.S. PATENT DOCUMENTS 5,522,223 A 6/1996 Yanai et al.
5,680,768 A * 10/1997 Rattray et al. ..... 62/52.1
5,791,149 A 8/1998 Dean
5,966,943 A 10/1999 Mitchell
6,161,389 A * 12/2000 Sekiya et al. ..... 62/6
6,282,895 B1 * 9/2001 Johansson et al. ..... 165/145
6,345,666 B1 * 2/2002 Conrad ..... 165/141

FOREIGN PATENT DOCUMENTS

NL 1017347 11/2001
WO 90/04144 4/1990

* cited by examiner

*Primary Examiner*—William C. Doerrler
(74) *Attorney, Agent, or Firm*—Birch, Stewart, Kolasch & Birch, LLP

(57) ABSTRACT

A pulse tube refrigerator is provided. A pulse tube is inserted into a regenerator such that the central axis of the pulse tube parallels the central axis of the regenerator and that a U-shaped working gas channel is formed by the pulse tube and the regenerator. It is possible to refrigerate more members by increasing the available area of a cold head formed in a cold heat exchanger. It is possible to reduce a restriction on the installing space of a refrigerating unit by reducing the length of the refrigerating unit. It is possible to reduce manufacturing cost by reducing the number of sealing members for the combination of a sealed cell.

5 Claims, 3 Drawing Sheets

PULSE TUBE REFRIGERATOR

BACKGROUND OF THE INVENTION

1. Field of the Invention

The present invention relates to a pulse tube refrigerator, and more particularly, to a pulse tube refrigerator, which is capable of increasing the available area of a cold heat exchanger and of reducing the size of a refrigerator.

2. Description of the Background Art

In general, a cryogenic refrigerator is a refrigerator of low oscillation and high reliability, which is used for refrigerating small electronic parts or a superconductor. A stirling refrigerator, a Giford-Mcmahon (GM) refrigerator, and a Joule-Thomson refrigerator are widely known.

However, the reliability of such refrigerators deteriorates when the refrigerators are driven at high speed. Also, additional lubricating means must be included for the abrasion of the portions that undergo friction during the driving of the refrigerators. Therefore, a cryogenic refrigerator, whose reliability is maintained during the high speed driving and which needs not be repaired for a long time because additional lubrication is not necessary, has been recently required. One of such cryogenic refrigerators is a pulse tube refrigerator.

FIG. 1 is a schematic sectional view showing an example of a conventional pulse tube refrigerator. As shown in FIG. 1, the conventional pulse tube refrigerator includes a driving unit 10 for generating the reciprocal movement of a working gas and a refrigerating unit 20 having a cold head due to the thermodynamic cycle of the working gas that is sucked up into/discharged from the driving unit 10 and is in a reciprocal movement in a plumbing line.

The driving unit 10 includes a closed case 11 having an inner space that shields a middle housing 11*b* and a lower housing 11*c*, an upper housing 11*a*, which is tightly coupled to the upper peripheral edge of the closed case 11 and in the middle of which a cylinder 10*a* is formed, a piston 14, which is located in the closed case 11, whose upper surface is tightly-coupled to the bottom of the upper housing 11*a*, to the inside of which an elastic supporter 15 is fastened, and which is inserted into the cylinder 10*a*, the middle housing 11*b*, in which a driving motor 12 including a driving axis 13 connected to the piston 14 is fixedly loaded, the lower housing 11*c*, which is located in the closed case 11, whose upper surface is tightly coupled to the lower surface of the middle housing, and to the inside of which an elastic supporter 16 is fastened, and a cover 11*d*, whose upper surface is tightly coupled to the bottom of the lower housing 11*c*.

The refrigerating unit 20 includes an aftercooler 21, which is tightly coupled to the upper housing 11*a* of the driving unit 10 and is connected to the cylinder 10*a*, a regenerator 22 connected to the other end of the aftercooler 21, a cold heat exchanger 23A connected to the other end of the regenerator 22, a pulse tube 23 connected to the other end of the cold heat exchanger 23A (that is, the inlet of the pulse tube), a hot heat exchanger 23B connected to the other end of the pulse tube 23 (that is, the outlet of the pulse tube), an inertance tube 24 connected to the other end of the hot heat exchanger 23B, a reservoir 25 connected to the other end of the inertance tube 24, and a sealed cell 26, which holds the regenerator 22 and the pulse tube 23, whose lower surface is tightly coupled to the upper surface of the aftercooler 21, in the middle portion of whose upper surface a through hole corresponding to the outer circumference of the pulse tube 23 is formed, and the middle portion of whose upper surface is tightly coupled to the outer circumference of the pulse tube 23.

The aftercooler 21 is formed of a metal and performs a function of a heat exchanger for removing the heat generated in the working gas when the driving unit 10 compresses the working gas.

The regenerator 22 is a kind of a heat exchanger for providing a means for letting the maximum amount of potential work (cooling power) reach a low temperature region with the working gas not having much heat. The regenerator 22 does not simply provide heat to a system or remove heat from the system.

The regenerator 22 absorbs heat from the working gas in a part of a pressure cycle and returns the absorbed heat to the pressure cycle in another part.

The cold heat exchanger 23A absorbs heat from a member to be cooled and forms the cold head.

The pulse tube 23 moves heat from the cold heat exchanger 23A to the hot heat exchanger 23B when a suitable phase relationship is established between a pressure pulse and the mass flow of the working gas in the pulse tube 23.

The hot heat exchanger 23B removes the heat that passed through the pulse tube 23 from the cold heat exchanger 23A.

The inertance tube 24 and the reservoir 25 provide a phase shift so that heat flow can be maximized under an appropriate design.

The conventional pulse tube refrigerator operates as follows.

When power is applied to the driving motor 12, the driving axis 13 is in a linear reciprocal movement together with the elastic supporters 15 and 16. The piston 14 integrally combined with the driving axis 13 is in the linear reciprocal movement in the cylinder 10*a* and sucks up/discharges the working gas of the refrigerating unit 20, to thus form the cold head in the cold heat exchanger 23A.

That is, the working gas compressed in the cylinder 10*a* and pushed out of the cylinder 10*a* when the piston 14 compresses the working gas is refrigerated to an appropriate temperature through the aftercooler 21 and is flown to the regenerator 22. The working gas that passed through the regenerator 22 is flown to the cold heat exchanger 23A of the pulse tube 23 and pushes the working gas filled in the pulse tube 23 toward the hot heat exchanger 23B. The working gas emits heat, while passing through the hot heat exchanger 23B, and is flown to the reservoir 25 through the inertance tube 24.

At this time, because the mass flow of the working gas that flows through the inertance tube 24 is relatively smaller than the mass flow of the working gas flown to the pulse tube 23, the inside of the pulse tube 23 forms thermal equilibrium at a high pressure.

When the working gas flown to the pulse tube 23 during the suction of the working gas by the piston 14 is returned to the cylinder 10*a*, while passing through the regenerator 22, the mass flow of the working gas returned to the pulse tube 23 through the inertance tube 24 is relatively smaller than the mass flow of the working gas returned from the pulse tube 23. Therefore, the working gas in the pulse tube 23 adiabatic expands. In general, the working gas rapidly adiabatic expands in the cold heat exchanger 23A. Therefore, the cold head is formed in the cold heat exchanger 23A.

Therefore, the inside of the pulse tube 23 forms the thermal equilibrium at a low pressure. The working gas continuously moves from the reservoir 25 to the pulse tube 23 through the inertance tube 24 and increases the pressure of the working gas in the pulse tube 23, to thus recover the initial temperature. Such a series of processes are repeated.

However, in the refrigerating unit of the conventional pulse tube refrigerator, the area of the cold heat exchanger 23A, to which a member to be actually refrigerated is attached, is narrow. Therefore, there is a limitation in refrigerating a large amount of members.

That is, the regenerator 22 is combined with one side of the cold heat exchanger 23A and the pulse tube is combined with the other side of the cold heat exchanger 23A. Therefore, the available area, to which the members to be refrigerated can be attached, is restricted to the outer circumference of the cold heat exchanger 23A.

As shown in FIG. 1, the entire length of the refrigerator increases because the regenerator 22, the pulse tube 23, the inertance tube 24, and the reservoir 25 are installed in a line. Therefore, a larger installment space is required.

Also, although the regenerator 22 and the pulse tube 23 must be vacuum insulated from each other and the hot heat exchanger 23B, the inertance tube 24, and the reservoir 25 must be exposed to the outside, the above-mentioned members are installed in a line. Accordingly, at least two sealing portions and members are required in order to combine the sealed cell 26 with the pulse tube 23. Therefore, the number of parts becomes excessive.

SUMMARY OF THE INVENTION

Therefore, an object of the present invention is to provide a pulse tube refrigerator, which is capable of increasing the available area of a cold heat exchanger having a uniform area.

Another object of the present invention is to provide a pulse tube refrigerator, which is capable of reducing a restriction on an installing space by reducing the length of a refrigerating unit.

Still another object of the present invention is to provide a pulse tube refrigerator, which is capable of reducing production cost by reducing the number of sealing members for vacuum insulating the refrigerating unit.

To achieve these and other advantages and in accordance with the purposes of the present invention, as embodied and broadly described herein, there is provided a pulse tube refrigerator, comprising an aftercooler connected to a cylinder for sucking up/discharging a working gas, the aftercooler for removing the heat caused by the compression of the working gas sucked up into/discharged from the cylinder, a regenerator connected to the aftercooler, the regenerator for storing the sensible heat of the working gas passing through the regenerator and returning the sensible heat when the working gas inversely passes through the regenerator, a pulse tube connected to one end of the regenerator, the pulse tube for compressing/expanding the working gas passing through the regenerator and forming heat flow, an inertance tube and a reservoir connected to the pulse tube, the intertance tube and the reservoir for causing phase shift between a pressure pulse and mass flow and generating the heat flow in the pulse tube, a hot heat exchanger for connecting the pulse tube to the inertance tube and for emitting the moved heat, and a cold heat exchanger for covering the regenerator and the pulse tube together such that connection channels are formed inside the cold heat exchanger in order to connect the regenerator to one end of the pulse tube inserted into the regenerator. The cold heat exchanger comprises a hollow cylindrical body combined with the outer circumference of the regenerator, a roughly hollow cylindrical central body, having a step and contacting and combined with the leading end of the pulse tube located in the middle of the body and the inner circumference of the regenerator, and a cover inserted into and combined with the inner circumference of the body on the body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A pulse tube refrigerator according to the present invention will now be described in detail with reference to an embodiment shown in the accompanying drawings.

Figure 1:
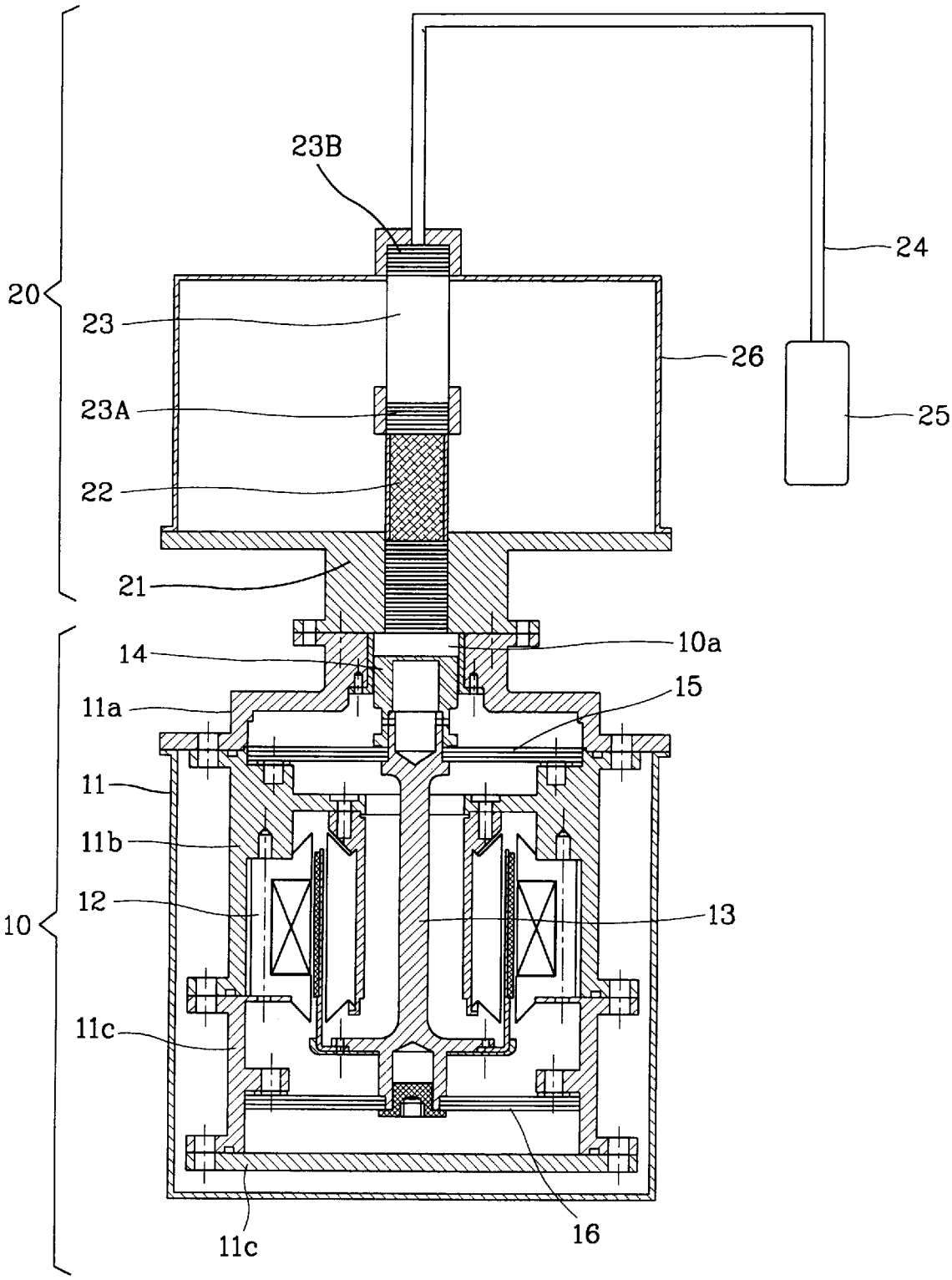
FIG. 1 CONVENTIONAL ART
FIG. 1 is a vertical sectional view showing an example of a conventional pulse tube refrigerator.
Figure 2:
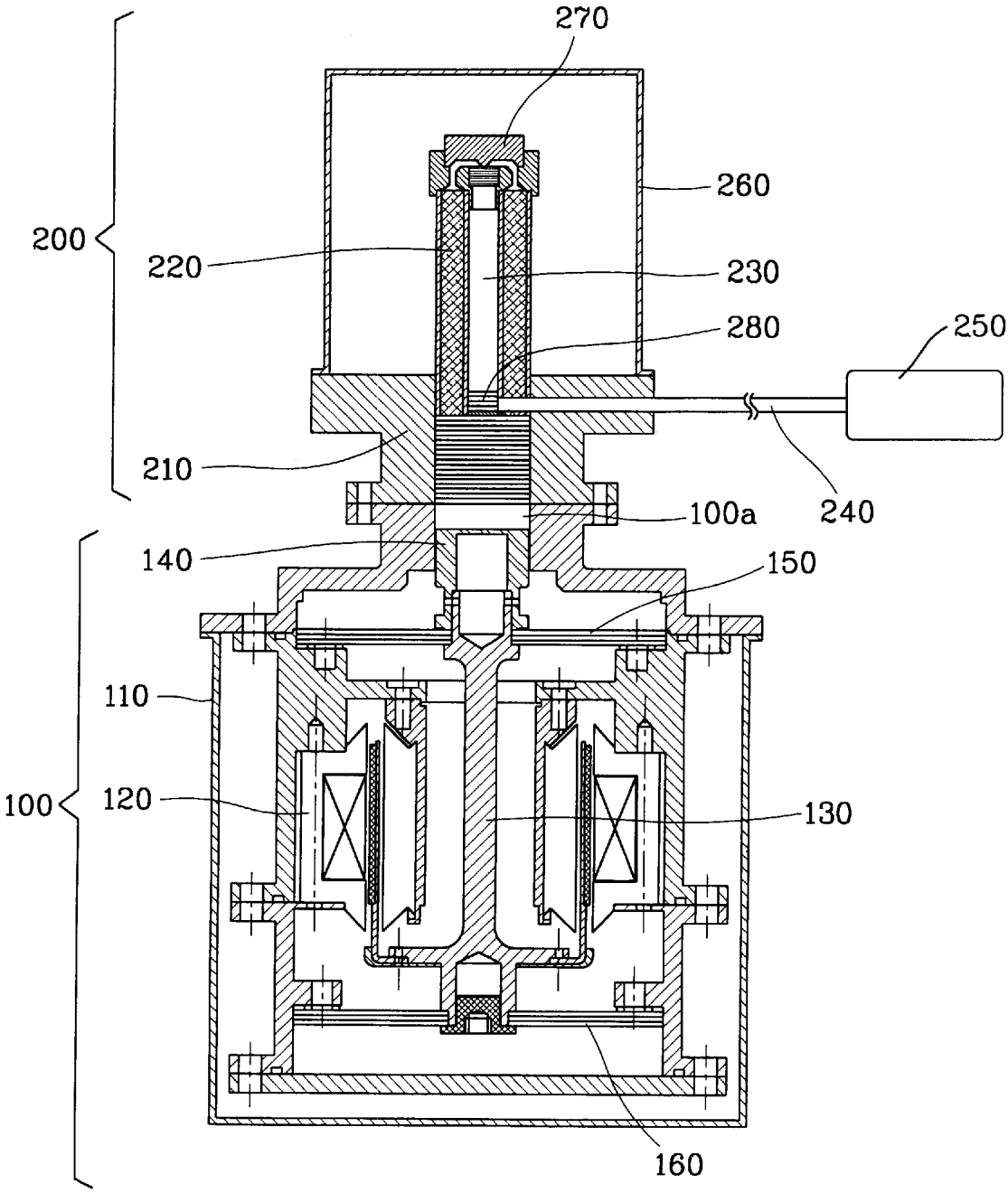
FIG. 2 is a vertical sectional view showing an example of a pulse tube refrigerator according to the present invention.
Figure 3:
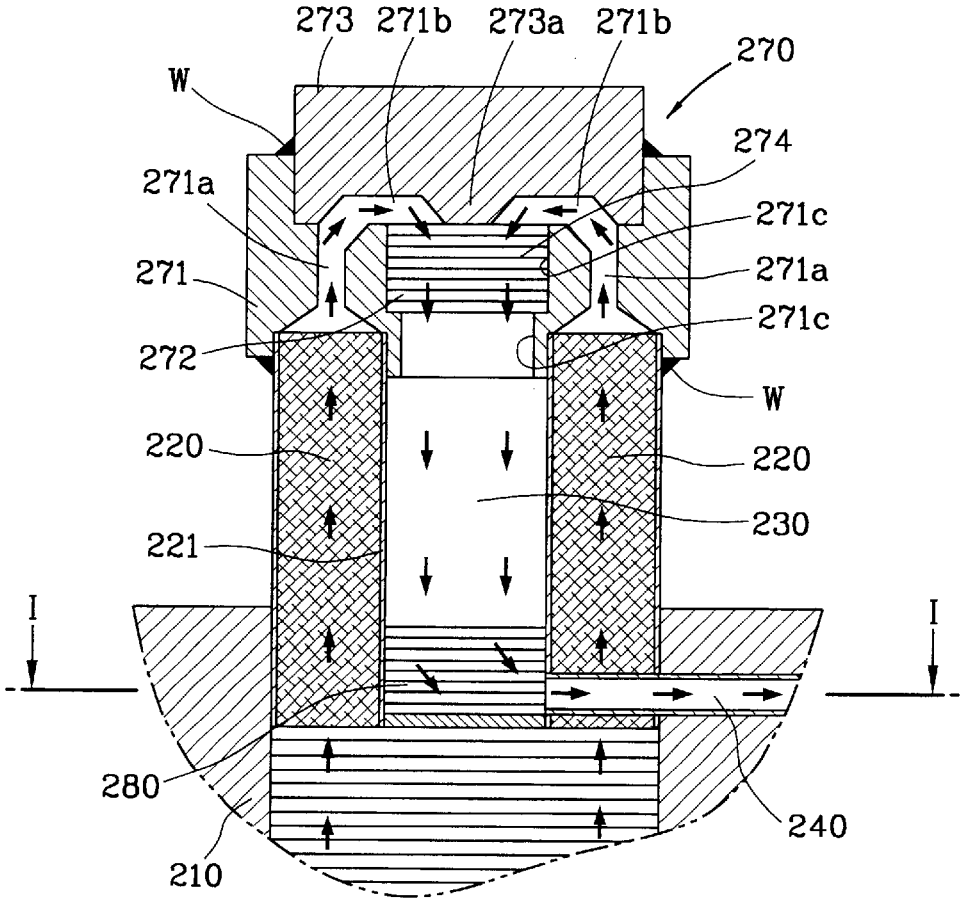
FIG. 3 is a sectional view showing the refrigerating unit of the pulse tube refrigerator according to the present invention.
Figure 4:
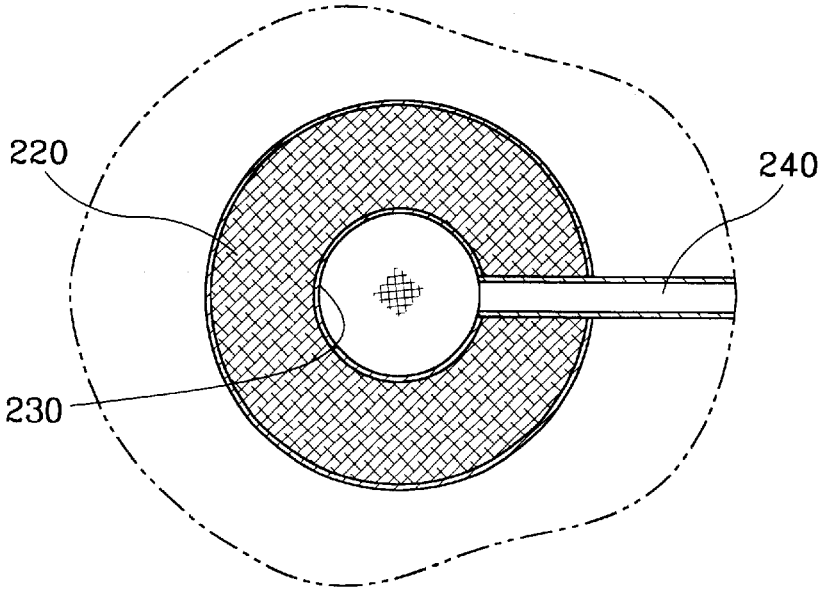
FIG. 4 is a sectional view taken along the ling 1—1 of FIG. 3.

FIG. 2 is a vertical sectional view showing a pulse tube refrigerator according to the present invention. FIG. 3 is a vertical sectional view showing the refrigerating unit of the pulse tube refrigerator according to the present invention. FIG. 4 is a sectional view taken along the line 1—1 of FIG. 3.

As shown in FIGS. 2, 3, and 4, the pulse tube refrigerator according to the present invention includes a driving unit 100 for sucking up/discharging a working gas and a refrigerating unit 200, which is connected to the driving unit 100 and in which a cold head is formed.

The refrigerating unit 200 is combined with the driving unit 100 by connecting an aftercooler 210, for refrigerating the working gas sucked up into/discharged from the cylinder 100a of the driving unit 100 so that the working gas has a certain temperature, to the cylinder 100*a*. A regenerator 220 for accumulating the sensible heat of the working gas when the driving unit 100 discharges the working gas and for transmitting heat to the working gas when the driving unit 100 sucks up the working gas, is connected to and combined with the aftercooler 210. A pulse tube 230 for forming the cold head according to the phase difference between a pressure pulse and the mass flow of the working gas is combined with the regenerator 220 inside the regenerator 220. An inertance tube 240 and a reservoir 250 for generating the phase difference of the working gas are combined with the pulse tube 230. A cap-shaped sealed cell 260 for vacuum insulating the regenerator 220 and the pulse tube 230 from each other is combined with one side of the aftercooler 210.

The regenerator 220 is a reticular system woven out of copper wire and is a cylinder, in the middle of which a through hole 221 is formed and whose section is ring-shaped. The pulse tube 230 is inserted into and combined with the through hole 221 of the regenerator 220.

The regenerator 220 is connected to the pulse tube 230 by covering the regenerator 220 and the pulse tube 230 with a cold heat exchanger 270. The cold heat exchanger 270, to the outer circumference of which devices such as superconductors are attached, is combined with the regenerator 220 and the pulse tube 230.

The cold heat exchanger 270 includes a hollow cylindrical body 271 combined with the outer circumference of the regenerator 220, a roughly hollow cylindrical central body 272, which contacts and is combined with the leading end of the pulse tube 230 and the inner circumference of the regenerator 220, and a cover 273 inserted into and combined with the inner circumference of the body 271 on the body 271.

A plurality of first connection channels 271*a* are radially formed on the same circumference in a space formed among a groove (no reference numeral) formed in the inner circumference of the body 271, the outer circumference of the central body 272 and the inner surface of the cover 273 and are connected to the regenerator 220. The first connection channels 271*a* can be formed by one inner circumference without the grooves (no reference numeral) formed in the inner circumference of the body 271.

A plurality of second connection channels 271*b* radially formed in a space between the upper surface of the central body 272 and the lower surface of the cover 273 are connected to the plurality of first connection channels 271*a*.

Also, third connection channels 271*c*, in the middle of which steps are formed, the third connection channels 271*c* for connecting the second connection channels 271*b* to the pulse tube 230 are formed inside the central body 272.

A heat exchanger 274 that is the reticular system woven out of the copper wire so that the working gas inside the pulse tube 230 can easily absorb heat from the outside is loaded on the third connection channels 271*c* of the central body 272.

A protrusion 273*a*, whose section is trapezoid, tightly contacts the inside of the cover 273 on the upper surface of the heat exchanger 274 for the sufficient transmission of heat.

The outer circumference of the body 271, the outer circumference of the regenerator 220, one side of the body 271, and one side of the cover 273 are welded for sealing.

Reference numerals 110, 120, 130, 140, 150 and 160, 280, and W denote a casing, a driving motor, a driving axis, a piston, elastic supporters, a hot heat exchanger, and welding portions.

The pulse tube refrigerator according to the present invention, which has the above structure, operates as follows.

That is, when power is applied to the driving unit 100, the driving axis 130 of the driving motor 120 of the driving unit 100 and the piston 140 combined with the driving axis 130 are in a linear reciprocal movement by the elastic supporters 150 and 160. When the piston 140 discharges the working gas, the working gas inside the cylinder 100*a* is flown to the aftercooler 210, is refrigerated to a certain temperature, and is flown to the regenerator 220. The working gas flown to the regenerator 220 U-turns through the cold heat exchanger 270 and is flown to the pulse tube 230 with the sensible heat stored. The working gas previously filled in the pulse tube 230 is pushed toward the hot heat exchanger 280 by the working gas newly flown to the pulse tube 230 and is flown to the reservoir 250 through the inertance tube 240.

When the piston 140 sucks up the working gas, the working gas filled in the reservoir 250 is returned to the pulse tube 230 through the inertance tube 240.

The working gas returned to the pulse tube 230 pushes the working gas previously filled in the pulse tube 230 and returns the working gas to the cylinder 100*a*. Accordingly, the cold heat exchanger 270 is refrigerated to a cryotemperature. Such a series of processes are repeated.

The working gas flown to the regenerator 220 through the aftercooler 210 diffuses inside the regenerator 220 and passes through the regenerator 220. The working gas U-turns through the first connection channels 271*a* of the body 271 and the second connection channels 271*b* connected to the first connection channels 271*a* and is flown to the pulse tube 230. The working gas passes through the cold heat exchanger 270, moves the hot heat exchanger 280 that faces the cold heat exchanger 270, and is flown to the inertance tube 240 and the reservoir 250. The working gas circulates in a reverse order when the piston 140 sucks up the working gas and is returned to the cylinder 100*a* of the driving unit 100.

At this time, the heat absorbed by the cold heat exchanger 270 moves to the hot heat exchanger 280 and is emitted according to the above flow of the working gas, to thus refrigerate the cold heat exchanger 270. Accordingly, the body 271 and the cover 273 form the cold heads.

When the pulse tube 230 is inserted into the regenerator 220, the regenerator 220 and the pulse tube 230 form a U-shaped working gas channel and the cold head, to which superconductor devices are to be attached, is formed in the U-shaped channel. Accordingly, the available area of the cold head extends to the outer circumference of the body 271 and the top of the cover 273.

Also, because the pulse tube 230 is inserted into the regenerator 220, the length of the refrigerating unit 200 is reduced. Accordingly, a restriction on the installing space of the pulse tube refrigerator is reduced.

Also, because the inertance tube 240 is penetratingly installed toward the aftercooler 210, the sealed cell 260 can be cap-shaped. Accordingly, because the vacuum insulation of the refrigerating unit 200 can be performed only by combining the opening of the sealed cell 260 with the aftercooler 210, only one sealing member is required for combining the sealed cell with the aftercooler 210. Therefore, the numbers of parts and processes are reduced.

The effect of the pulse tube refrigerator according to the present invention will now be described as follows.

In the pulse tube refrigerator according to the present invention, when the pulse tube is inserted into the regenerator, the regenerator and the pulse tube are connected to the cold heat exchanger consisting of the body and the cover. Accordingly, it is possible to attach more devices to the cold head, to thus refrigerate more devices because the available area of the generated cold head increases. The restriction on the installing space is reduced because the length of the refrigerating unit is reduced. Manufacturing cost is reduced because the number of sealing members used for the combination of the sealed cell is reduced.

What is claimed is:

1. A pulse tube refrigerator, comprising:

an aftercooler connected to a cylinder for sucking up/discharging a working gas, the aftercooler for removing the heat caused by the compression of the working gas sucked up into/discharged from the cylinder;

a regenerator connected to the aftercooler, the regenerator for storing the sensible heat of the working gas passing through the regenerator and returning the sensible heat when the working gas inversely passes through the regenerator;

a pulse tube connected to one end of the regenerator, the pulse tube for compressing/expanding the working gas passing through the regenerator and forming heat flow;

an inertance tube and a reservoir connected to the pulse tube, the intertance tube and the reservoir for causing phase shift between a pressure pulse and mass flow and generating the heat flow in the pulse tube;

a hot heat exchanger connecting the pulse tube to the inertance tube and emitting moved heat; and a cold heat exchanger for covering the regenerator and the pulse tube together such that connection channels are formed inside the cold heat exchanger in order to connect the regenerator to one end of the pulse tube inserted into the regenerator, wherein the cold heat exchanger comprises:

a hollow cylindrical body combined with the outer circumference of the regenerator;

a roughly hollow cylindrical central body, having steps and contacting and combined with the leading end of the pulse tube located in the middle of the body and the inner circumference of the regenerator; and a cover inserted into and combined with the inner circumference of the body on the body.

2. The pulse tube refrigerator of claim 1, wherein a plurality of first connection channels are radially formed in a space formed among the inner circumference of the body, the outer circumference of the central body, and the inner surface of the cover and are connected to the regenerator.

3. The pulse tube refrigerator of claim 2, wherein second connection channels are formed in a space between the upper surface of the central body and the lower surface of the cover and are connected to the plurality of first connection channels, respectively.

4. The pulse tube refrigerator of claim 1, wherein third connection channels, are formed in the central body, the third connection channels connecting the second connection channels to the pulse tube.

5. The pulse tube refrigerator of claim 4, wherein a heat exchanger is inserted into and combined with the third connection channels formed in the central body and connected to the pulse tube.

* * * * *